US005467747A

United States Patent [19]

Brandt et al.

[11] Patent Number: 5,467,747

[45] **Date of Patent: * Nov. 21, 1995**

[54] NOISE SUPPRESSION ENCLOSURE FOR AN ENGINE

[75] Inventors: Everett G. Brandt, Chillicothe; M. Kathryn Christensen, Metamora; W. Charles Sahm, Peoria, all of Ill.

[73] Assignee: Caterpillar Inc., Peoria, Ill.

[ * ] Notice: The portion of the term of this patent subsequent to Mar. 24, 2011, has been disclaimed.

[21] Appl. No.: 179,634

[22] Filed: Jan. 10, 1994

Related U.S. Application Data

[63] Continuation of Ser. No. 721,422, Aug. 19, 1991, Pat. No. 5,297,517.

[51] Int. Cl.[6] ..... F02B 77/00

[52] U.S. Cl. ..... 123/198 E; 181/204

[58] Field of Search ..... 123/198 E, 2; 181/204, 290, 206

*Primary Examiner*—Noah P. Kamen

*Attorney, Agent, or Firm*—Dennis C. Skarvan

[57] ABSTRACT

Most existing noise reduction enclosures used with engines and engine driven equipment have failed to meet the reduced noise emission requirements of today and of the future. A few of the present enclosures meet the reduced noise emission requirements of today and of the future but are extremely expensive to purchase and are large bulky structures. The subject enclosure (10) is reasonably priced and provides an enclosure which is effective in reducing the noise emitted therefrom. The enclosure (10) includes a housing (32) having a generally rectangular configuration and being divided into an engine portion (56) defining an engine compartment (57) and a duct portion (54). The outlet ducts (88) having a length greater than the inlet ducts (84). To further enhance the noise reduction of the enclosure (10) a plurality of dynastic hardware is attached to the housing (32).

20 Claims, 4 Drawing Sheets

NOISE SUPPRESSION ENCLOSURE FOR AN ENGINE

This is a continuation application of application Ser. No. 07/721,422, filed Aug. 19, 1991, U.S. Pat. No. 5,297,517.

TECHNICAL FIELD

This invention relates generally to noise suppression of engine driven equipment and more particularly to a system for reducing noise emitted from an engine enclosure with passive and active sound suppression.

BACKGROUND ART

Due to the ever increasing use of engine driven equipment, such as generator sets, environmental concerns are forcing the noise emitted from such equipment to be lower and lower. These generator sets are often used in areas where low noise is a requirement. Such uses include construction sites within residential areas, carnivals and movie sets. Thus, the market for sound suppression enclosures is increasing, and the premium charged for such enclosures is currently quite high. For example, the cost of some low noise enclosures is approximately equal to the cost of the engine and generator packages without an enclosure.

An example of an enclosure is disclosed in U.S. Pat. No. 3,462,949 issued to Howard R. Anderson, et al. on Aug. 26, 1969. An enclosure for a gas turbine engine is comprised of a silencer for the engine's compressor and a specially configured compressor inlet housing to provide uniform flow free of turbulence or separation. The enclosure is comprised of an inlet duct means for turning the incoming air through a plurality of right-angle bends, thus silencing any compressor noise.

Another example of an existing enclosure is disclosed in U.S. Pat. No. 4,071,009 issued to Jack H. Kraina on Jan. 31, 1978. The enclosure is mounted around the engine and is comprised of an outer enclosure having a horizontally disposed hood and side walls. An inner enclosure is disposed within the outer enclosure and has a horizontally disposed upper wall spaced vertically between the top of the engine and the hood to define first and second airflow passages therewith. An airflow guide means is secured internally on each of the sidewalls to define a passage therebetween which communicates with the second airflow passage. The hood, sidewalls and upper and forward walls of the inner enclosure each have a layer of sound absorbing material secured thereon.

An example of an existing enclosure is disclosed in U.S. Pat. Re. No. 29,923 issued to Gerhard Thien, et al. on Mar. 6, 1979. The soundproof casing is divided by at least one partition wall into two cooling air ducts separated from each other. One of the ducts contains all fuel carrying members of the engine, and the second duct contains the exhaust system of the engine.

The noise reduction enclosure defined herein reduces the noise emitted from engine driven equipment and provides noise reduction enclosure at an economical cost to the customer.

DISCLOSURE OF THE INVENTION

In one aspect of the invention, a noise reduction enclosure has been adapted for use with an engine. The noise reduction enclosure is comprised of a housing having a generally rectangular shape which surrounds the engine. The enclosure is divided into a duct portion and an engine portion defining an engine compartment. The enclosure further includes a housing having a generally rectangular shape surrounding the engine and is divided into a duct portion and an engine portion defining an engine compartment. The housing further includes a plurality of formed sheet material skins attached one to another. Each of the plurality of skins are relatively thin and at least a portion thereof have an inlet opening and an outlet opening therein. Each of the plurality of skins have an interior surface of which at least a portion of the interior surfaces are adjacent the engine. The enclosure further has a damping material and an absorptive material fixedly attached to at least a portion of the interior surfaces. The enclosure further includes an inlet duct having a preestablished length through which the cooling medium flows and is positioned within the housing. The inlet duct interconnects the inlet opening, through which the cooling medium enters, and the engine compartment. The enclosure further includes an outlet duct having a preestablished length, through which the cooling medium flows, and is positioned within the housing external of the inlet duct as related to the engine. The outlet duct interconnects the outlet opening through which the cooling medium exits and the engine compartment. The preestablished length of the outlet duct has a greater length than the preestablished length of the inlet duct.

In another aspect of the invention, an engine has a noise reduction enclosure positioned therearound. The engine includes a cooling system having a heat exchanger connected to the engine for dissipating the heat generated by the engine. The heat exchanger has a coolant therein which is circulated through the heat exchanger and the engine by a circulating means. A fan is drivingly connected to the engine forcing a cooling medium through the heat exchanger to dissipate heat from the coolant flowing therethrough. The noise reduction enclosure is comprised of a housing having a generally rectangular shape which surrounds the engine. The housing includes an engine portion defining an engine compartment and a plurality of sheet material skins each having an interior surface thereon of which at least a portion of the interior surfaces are adjacent the engine. The noise reduction enclosure is further comprised of a damping material and an absorptive material fixedly attached to at least a portion of the interior surfaces. The housing further includes an inlet opening and an outlet opening within at least a portion of the sheet material skins. The enclosure further has an inlet duct having a preestablished length through which the cooling medium flows and is positioned within the housing. The inlet duct interconnects the inlet opening, through which the cooling medium enters, and the engine compartment. The enclosure further includes an outlet duct having a preestablished length, through which the cooling medium flows, and is positioned within the housing external of the inlet duct as related to the engine. The outlet duct interconnects the outlet opening, through which the cooling medium exits, and the engine compartment. The preestablished length of the outlet duct has a greater length than the preestablished length of the inlet duct.

In another aspect of the invention, a noise reduction enclosure has been adapted for use with an engine. The engine emits noise and has a cooling medium flowing therearound. The noise reduction enclosure is comprised of a housing having an engine portion defining an engine compartment and is formed from a plurality of sheet material skins. The housing has a generally rectangular shape which surrounds the engine. Each of the plurality of skins have an interior surface of which at least a portion of the interior surfaces are adjacent the engine. The enclosure is further comprised of a damping material and an absorptive material which are fixedly attached to at least a portion of the interior surfaces. The plurality of sheet material skins are relatively thin and at least a portion thereof have an inlet opening and an outlet opening therein. The enclosure further includes an inlet duct has a preestablished length and is positioned within the housing. The inlet duct interconnects the inlet opening, through which the cooling medium enters, and the engine compartment. The enclosure further includes an outlet duct having a preestablished length and is positioned within the housing external of the inlet duct as related to the engine. The outlet duct interconnects the outlet opening, through which the cooling medium exits, and the engine. The inlet duct and the outlet duct have a generally square cross-sectional configuration. The preestablished length of the outlet duct is greater than the preestablished length of the inlet duct. The enclosure further includes means for actively reducing noise which is connected to the housing.

BEST MODE FOR CARRYING OUT THE INVENTION

Figure 1:
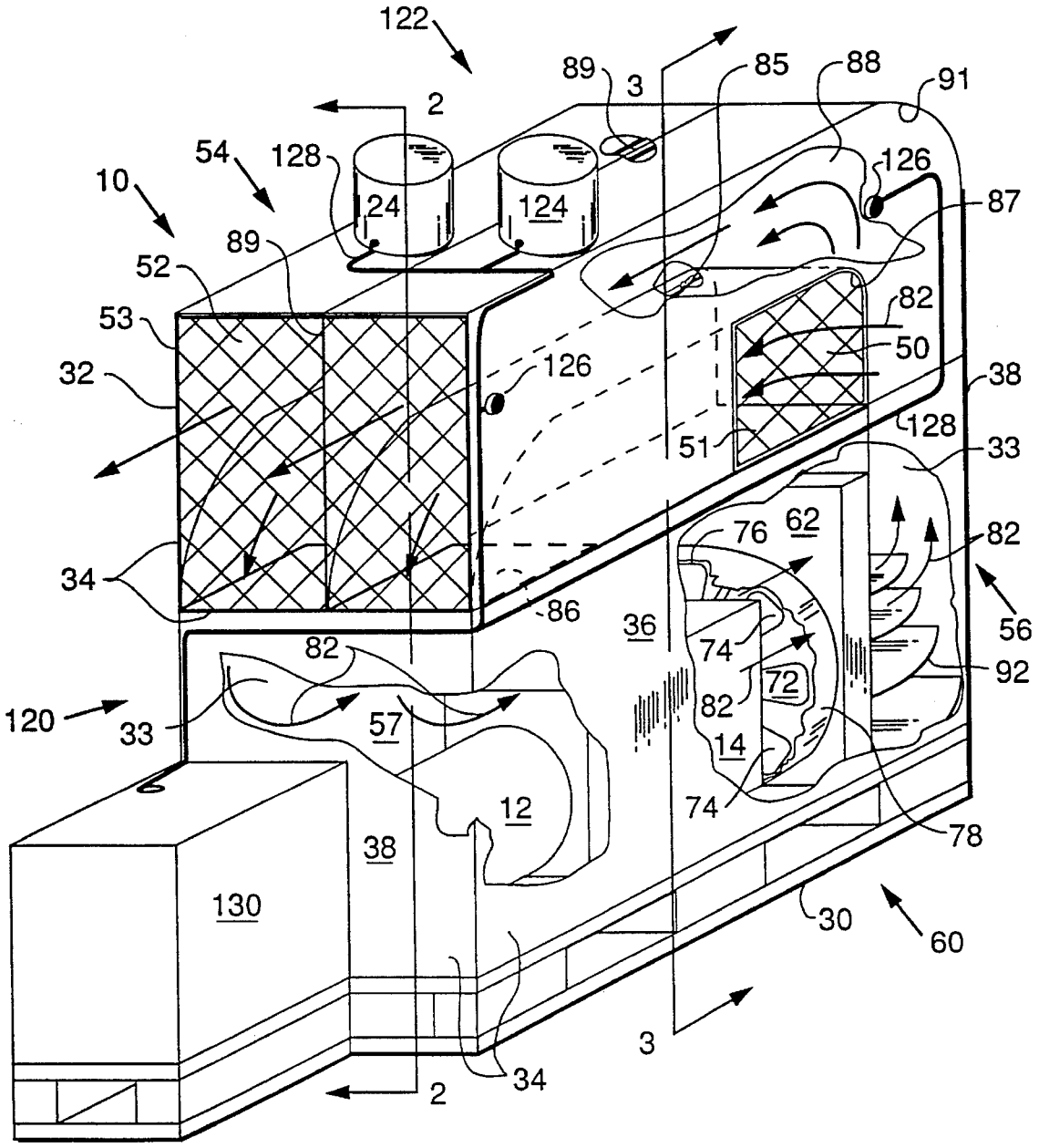
FIG. 1 is an isometric view of a noise reduction structure.
Figure 2:
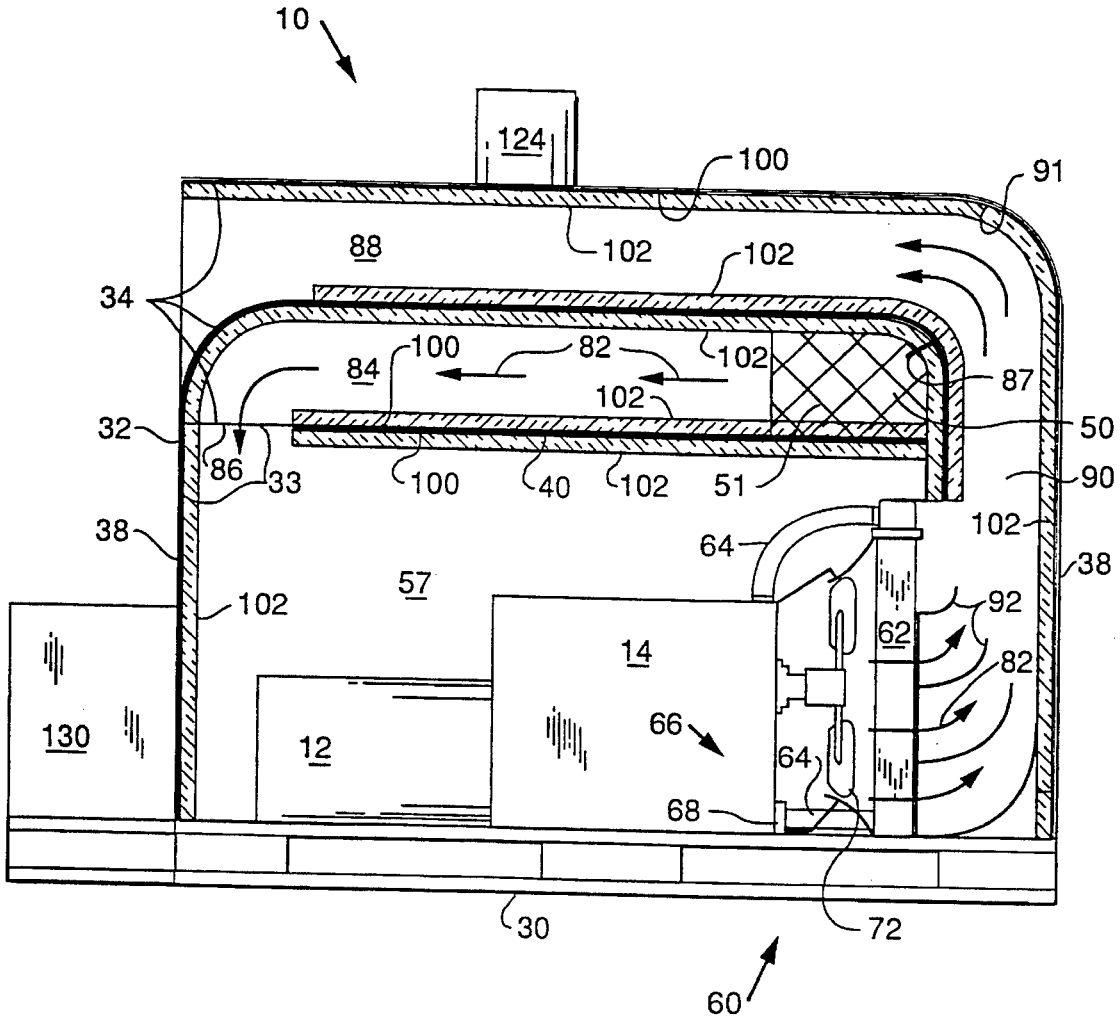
FIG. 2 is a cross-sectional view taken along line 2—2 of FIG. 1.
Figure 3:
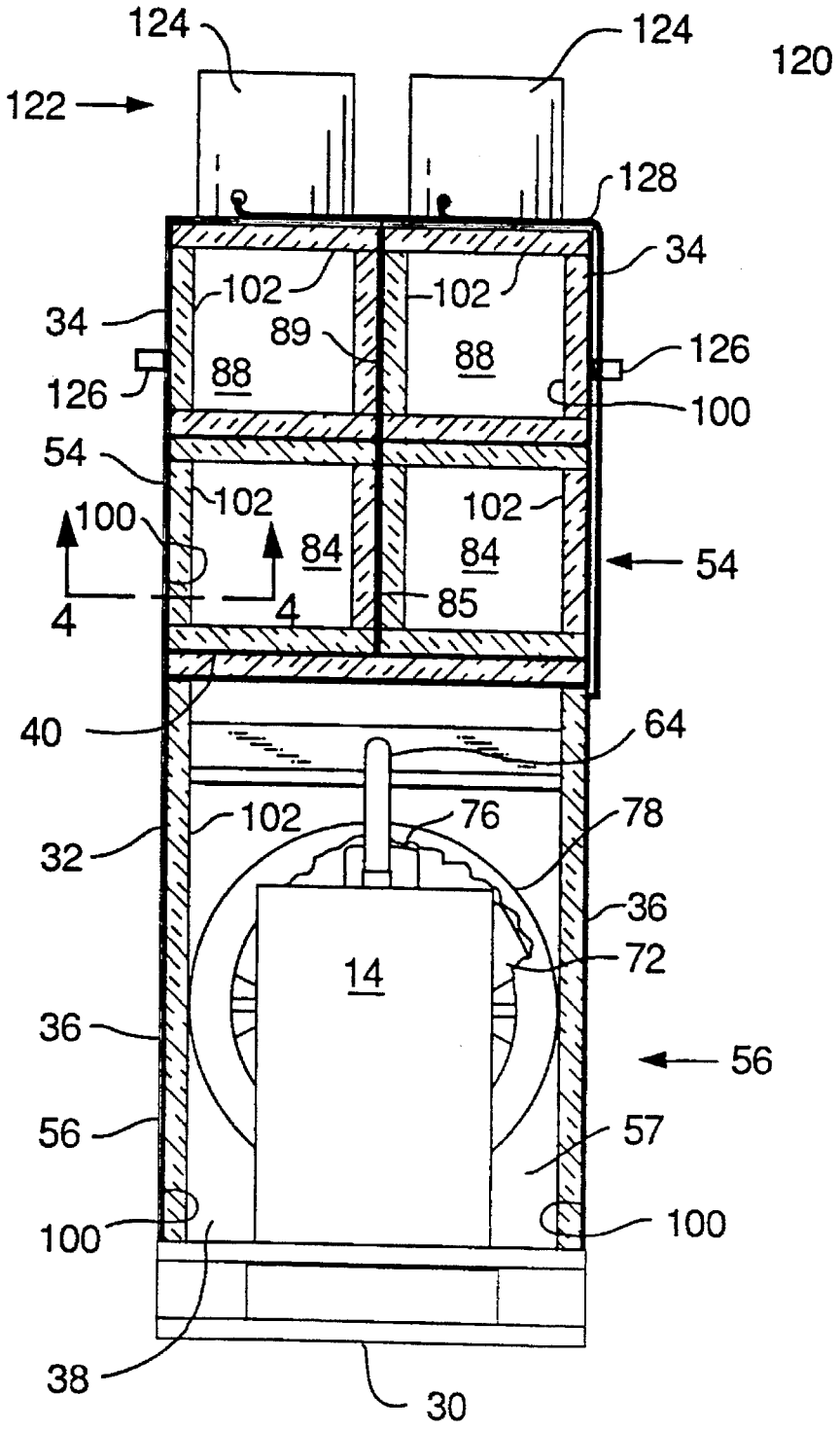
FIG. 3 is a cross-sectional view taken along line 3—3 of FIG. 1.

Referring to FIGS. 1, 2 and 3 a noise reduction enclosure 10 is disclosed. The enclosure 10 has been adapted to be used with an engine driven piece of equipment 12, such as a generator set or a compressor set. An engine 14 and the driven equipment 12 are of a conventional type and include a conventional fuel system, air intake system, control system, not shown, and a conventional exhaust system, only partially shown.

The noise reduction enclosure 10 includes a conventional skid or mounting base 30 having a fuel reservoir, not shown, therein. The engine 14 and the driven piece of equipment 12 are removably, isolatingly mounted to the base 30 in a conventional manner. Positioned around the engine 14 and the driven equipment 12 is a housing 32 having a generally rectangular shape. The housing 32 includes a plurality of interior surfaces 33 of which a portion of the surfaces are adjacent the engine 14 and the engine driven piece of equipment 12. The housing 32 further includes a plurality of formed sheet material pieces or skins 34 having a thickness of between 2.5 mm to 4 mm. In this application the thickness of the skins 34 are 3.5 mm. The plurality of skins 34 include a pair of side walls 36, a pair of end walls 38 and a top wall 40. Each of the pair of side walls 36 has an inlet opening 50 therein generally located toward one of the end walls 38. The inlet opening 50 is covered by a perforated plate or grate 51 to prevent entry of large particles, such as sandwich wrappers, napkins or other flying products. The end wall 38 furthest away from the inlet opening 50 has an outlet opening 52 therein. Like the inlet opening 50, the outlet opening 52 is covered by a perforated plate or grate 53 to prevent entry of large particles. As an alternative, the housing 32 could include a structural frame, not shown, fixedly attached to the base 30 such as by welding. The frame could be removably attached to the base 30 without changing the gist of the invention. The frame could be formed by attaching a plurality of structural plates to form a generally rectangular configuration about the engine 14 and the equipment 12. The plates could be of an angle, channel or box section configuration. If the frame is used, the skins 34 would be attached to the frame 34 in a conventional manner, such as by bolts or rivets.

The noise reduction enclosure 10 is divided into a ducting portion 54 and an engine portion 56. The engine portion 56 defines an engine compartment 57 therein. The engine 14, the driven equipment 12, and a cooling system 60 are positioned within the engine compartment 57. The cooling system including a heat exchanger 62, a pair of hoses 64 connecting the heat exchanger 62 with the engine 14 and a circulating means 66 which in this application is a pump 68 drivingly connected to the engine 14 for circulating a coolant, not shown, through the engine 14 and the heat exchanger 62. The cooling system 60 further includes a fan 72, having a plurality of blades 74 and a tip 76 on each blade 74, and a conically configured shroud 78 attached to the engine 14. The fan 72 is drivingly connected to the engine 14 and the shroud 78 is attached to the engine 14 to provide a relative close fit between the tips 76 of the plurality of fan blades 74 and the shroud 78. The shroud 78 is in sealing relationship to the heat exchanger 62 and the interior of the skins 34 making up the outer shell of the engine compartment 57 of the housing 32. The fan 72 directs a cooling medium, such as air, designated by the arrows 82, through the heat exchanger 62. The ducting portion 54 includes an inlet ducts 84 positioned within the housing 32. A partition 85 is positioned within the inlet duct 84 dividing the inlet duct 85 into a pair of generally square cross-sectionally configured inlet ducts. Each of the ducts 84 separately interconnects one of the inlet openings 50 on each of the side walls 40 with a duct outlet 86 exiting into the engine compartment 57. The cooling medium 82 is drawn through each of the inlet openings 50 by the fan 72, flows through the inlet duct 84 around a curved portion 87 formed by a portion of the skin 34 forming the inlet duct 84, exits the duct outlet 86 into the engine compartment 57 near the end having the outlet opening 52 therein. The curved portion 87 formed in the portion of the skin 34 forming the inlet duct 84 has a 90 degree turn in this application. The cooling medium 82 is further directed by the fan 72 to be circulated along the driven equipment 12, the engine 14 and through the heat exchanger 62 to absorb heat from the coolant. The ducting portion 54 further includes an outlet ducts 88 positioned within the housing 32. A partition 89 is positioned within the outlet duct 88 and divides the outlet duct 88 into a pair of generally square cross-sectionally configured outlet ducts 88. The outlet ducts 88 are further positioned externally of the inlet ducts 84 as related to the engine 14. Each of the ducts 88 interconnects the outlet opening 52 in one of the ends 38 with a duct inlet 90 positioned near the end 38 opposite duct outlet 86 of the inlet duct 84 to the engine compartment 57 of the housing 32. The outlet duct 88 includes a curved portion 91 positioned therein being formed by a portion of the skin 34 forming the outlet duct 88. The curved portion 91 has a 90 degree angle and is positioned near the duct inlet 90 in this application. The fan 72 causes the cooling medium 82 after passing through the heat exchanger 62 and having a portion of the heat absorbed from the coolant to pass through the duct inlets 90 in each of the outlet ducts 88 and exits the outlet openings 52. Each of the inlet ducts 84 has a preestablished length through which the cooling medium flows and a generally square cross-sectional configuration along substantially its entire length. Each of the outlet ducts 88 has a preestablished length through which the cooling medium 82 flows and a generally square cross-sectional configuration along substantially its entire length. The preestablished length of each of the outlet ducts 88 is greater than the preestablished length of each of the inlet ducts 84. The preestablished length of each of the inlet ducts 84 are equal to each other and the preestablished length of each of the outlet ducts 88 are equal to each other. A plurality of guide vanes 92 are positioned within the engine compartment 57 between the heat exchanger 62 and the duct inlet 90. In this application, the engine portion 56 and the duct portion 54 can be separated into two individual modules. The top wall 40 of the engine portion 56 is used to form the bottom skin of the duct portion 54 and remains with the engine portion 56 when the modules are separated.

Figure 4:
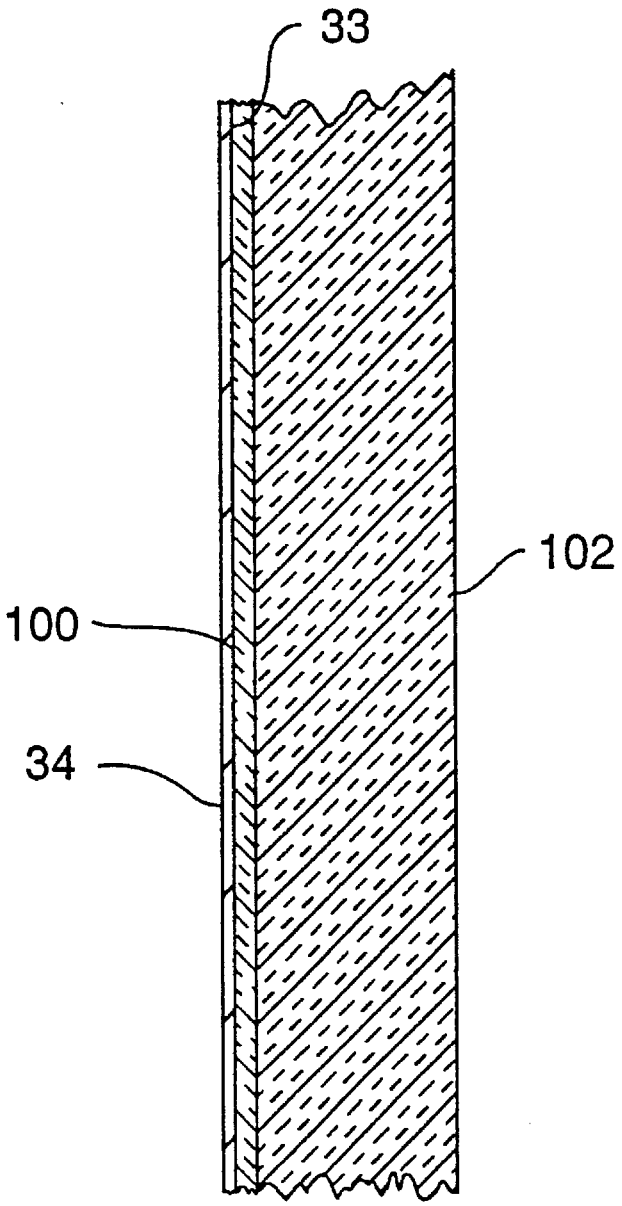
FIG. 4 is a cross-sectional view taken along line 4—4 of FIG. 3.

As best shown in FIGS. 2, 3 and 4, at least a portion of the plurality of formed sheet material pieces or skins 34 have a dampening material 100 fixedly attached thereto, such as by gluing. The mounting base 30 does not have dampening material 100 attached thereto. In this application, the dampening material is highly effective in reducing vibrational resonance conditions in structures such as sheet metal panels. The dampening material is resistant to water and a variety of solvents, acids and corrosive gasses. The dampening material used in this application can be purchased from H. L. Blachford, Inc. which has a Midwestern Regional Sales and Manufacturing Facility located at 1400 Nuclear Drive West Chicago, Ill. 60185 and is sold under the trade name "AQUAPLAS" and can be purchased in sheet form or liquids. In this application, the "AQUAPLAS" sheets have a thickness of between about 6 mm to 10 mm. In this application, the dampening material 100 is attached to only a portion of the inside surfaces of the side walls 36, end walls 38, and top wall 40 located within the engine compartment 57 of the noise reduction enclosure 10. Approximately 80 percent of the interior of the side walls 36, end walls 38, and top wall 40 within the engine compartment 57 is covered with "AQUAPLAS". Further fixedly attached, such as by gluing, to the "AQUAPLAS" and the interior of the skins 34 is an absorptive material 102 such as an acoustic foam or fiberglass. The foam or fiberglass used in the engine compartment 57 has been treated to have an oil resistance barrier thereon. Furthermore, the edges of the foam or fiberglass 102 are tucked or formed into the corners and along the edges and have a oil resistance barrier attached thereto. The foam or fiberglass 102 has a preestablished thickness of between about 20 mm to 60 mm. In this application, the preestablished thickness of the majority of the foam or fiberglass 102 used within the engine compartment 57 is about 50.8 mm. In areas where the space limitations prevent the use of the 50.8 mm foam or fiberglass 102 a foam or fiberglass having a thickness of about 25.4 mm is used. Each of the inlet ducts 84 and the outlet ducts 88 have a layer of the acoustic foam or fiberglass 102 fixedly attached to the interior thereof. The foam or fiberglass 102 has a preestablished thickness of between about 20 mm to 60 mm. In this application, the preestablished thickness of the foam or fiberglass attached to the interior of the ducts is about 25.4 mm.

To further enhance the reduction of noise, the noise reduction enclosure 10 includes means 120 for actively reducing noise. The means 120 for actively reducing noise includes a plurality of dynastic hardware 122. For example, the dynastic hardware includes a speaker 124 attached to the top wall 40 of each of the outlet ducts 88. The means 120 further includes a plurality of microphones or sensors 126 positioned within each of the outlet ducts 88. One of the plurality of sensors 126 is positioned near the duct inlet 90 of each of the outlet ducts 88 and a second sensor 126 is positioned near each of the outlet openings 52. A wiring harness 128 having a plurality of wires, not shown, is attached at one end to the plurality of sensors 126 and the pair of speakers 124. The other end of the wiring harness is connected to a control module or computer 130 in which the impulses from the sensors 126 are evaluated, can be recorded, and interpreted to determine the frequency to be emitted from the speakers 124.

Industrial Applicability

In use, the noise reduction enclosure 10 reduces the noise emitted from a conventional engine and generator package by over 22 dB(A). The noise emitted from the enclosure 10 is further reduced by an additional average of 1.4 dB(A) when the means 120 for actively reducing noise is added to the noise reduction enclosure 10. Furthermore, the noise emitted from the exit end of the enclosure 10 is further reduced by 5 dB(A) when the means 120 for actively reducing noise is added to the noise reduction enclosure 10.

In operation, the engine 14 is started. Air in the engine compartment 57 of the engine portion 56 of the enclosure 10 is used to mix with the fuel to operate the engine 14. As the engine 14 is operated, the engine operation causes the cooling fan 72 to draw the cooling medium 82, which is atmospheric air, through the grates 51 and the inlet openings 50 on each side of the inlet duct 84. The inlet openings 50 are positioned on the sides so that rain or snow does not naturally enter the inlet openings 50. The cooling medium 82 travels along the preestablished length of the inlet duct 84, is directed by the curved portion 87, which helps to reduce turbulences, and enters into the engine compartment 57 of the enclosure 10.

The cooling medium 82 travels along the exterior of the generator set 12 and the engine 14 absorbing heat therefrom. The cooling medium 82 enters the shroud 78 contacts the fan 72 and is forced through the heat exchanger 62. The sealing relationship between the shroud 78, heat exchanger 62 and the interior surfaces of the skins 34 making up the engine compartment 57 increases the efficiency of the cooling system 60 and insures effective cooling of the engine 14. The relative relationship of the shroud 78 and the tip 76 of the fan blades 74 further increases the flow of cooling medium 82 through the heat exchanger 62. After the cooling medium 82 has passed through the heat exchanger 62 and absorbed a portion of the heat from the coolant, the cooling medium 82 is exhausted from the engine compartment 57 of the enclosure 10. The guide vanes 92 direct the heated cooling medium 82 toward the duct inlet 90 and into the outlet duct 88. After entering into the outlet duct 88, the cooling medium 82 is redirected by the curved portion 91, helping to reduce turbulences, and travels the length of the outlet duct 88. As the cooling medium 82 travels along the outlet duct 88 the noise traveling therewith is at least partially absorbed by the absorption material 102 and the noise level emitted at the outlet opening 52 is reduced.

When the enclosure 10 as described above is used with the means 120 for actively reducing noise the additional operation and activities take place. The noise level entering the outlet duct 88 is monitored by the sensor 126. The resulting impulses from the sensor 126 are directed along the plurality of wires within the wiring harness 128 to the control module 130. The module 130 interprets the impulses and sends a signal to the speaker 124 in the outlet duct 88 causing a sound wave to be directed into the outlet duct 88. The sound wave from the speaker 124 counteracts a portion of the noise waves and reduces the noise emitted from the enclosure 10. A second sensor 126 positioned near the outlet opening 52 in the outlet duct 88 monitors the results of the counteracting sound wave. The resulting pulses are directed along the plurality of wires within the harness 128 to the control module 130. The module 130 interprets the pulses and further modifies the sound wave being transmitted from the speaker 124 to better counteract the noise being emitted from the enclosure 10.

In general the following advantages and reasons for these advantages are listed below. The thickness of the skins 34 has been found to add to the reduction of noise emitted from the enclosure since the thickness increases the transmission loss over conventional enclosures having a thickness of typically 1.5 mm to 2.0 mm. In reality, the noise attenuation is increased with the increased thickness of the skins 34; cost, however, must be evaluated relative to the increase in noise attenuation. Thus, the cost of the increased thickness verses the degree of increased attenuation has been evaluated and at this time determined to be most cost effective with the thickness of the skins 34 being about 3 mm to 3.5 mm. The positioning of the duct portion 54 on top of the engine enclosure 57 formed by the engine portion 56 minimizes the floor space required for the enclosure. Minimizing floor space is important since many installations are priced per unit of floor area. Experimentation has shown that the largest cross sectional dimension of a duct determines the effective cutoff frequency for the passive attenuation, smaller ducts provide higher cutoff frequency. Therefore, square ducts provide better attenuation than rectangular ducts having the same short length. Thus, the application of two square inlet ducts 84 and two square outlet ducts 88 provides maximum sound suppression. The cross-sectional area of the ducts used in this application was selected to provide a cutoff frequency of 360 Hz which corresponds to the second fundamental fan 72 and engine 14 frequency and can be attenuated well with both active and passive sound suppression. Furthermore, since the duct passive attenuation is a function of length, and the noise level is higher when traveling with the cooling medium 82 than against the cooling medium 82, more attenuation is necessary on the outlet cooling medium 82 side than on the cooling medium 82 inlet side. Additionally, since one of the noise sources, the fan 72 is closer to the outlet cooling medium 82 more attenuation is necessary on the outlet cooling medium 82 side than on the cooling medium 82 inlet side. Thus, the preestablished relationship between the length of the inlet duct 84 versus the greater length of the outlet duct 88.

Other aspects, objects and advantages of this invention can be obtained from a study of the drawings, the disclosure and the appended claims.

We claim:

1. A noise reduction enclosure (10) adapted for use with an engine (14), comprising:

a housing (32) having a generally rectangular shape and being divided into a duct portion (54) and an engine portion (56);

said duct portion (54) being disposed above said engine portion (56) and having an inlet opening (50) and an outlet opening (52) in fluid communication therewith;

said duct portion (54) further including an inlet duct (84) through which a cooling medium (82) flows from said inlet opening (50) to said engine portion (56) and an outlet duct (88) through which said cooling medium (82) exits from said engine portion (56) to said outlet opening (52);

said inlet duct (84) and said outlet duct (88) each having at least one curved portion (87,91) and being disposed adjacent one another within said duct portion (54); and an absorptive material (102) attached to at least a portion of the interior surfaces of said inlet duct (84) and said outlet duct (88).

2. The noise reduction enclosure (10) of claim 1, wherein one of said inlet duct (84) and said outlet duct (88) is disposed in said duct portion (54) between the other of said inlet duct (84) and outlet duct (88) and said engine portion (56).

3. The noise reduction enclosure (10) of claim 2, wherein said inlet duct (84) is disposed in said duct portion (54) between said outlet duct (88) and said engine portion (56).

4. The noise reduction enclosure (10) of claim 3 wherein said housing (32) includes a side wall (36) and an end wall (38), said inlet opening (50) being positioned in said side wall (36) and said outlet opening (52) being positioned in said end wall (38).

5. The noise reduction enclosure (18) of claim 1, wherein each of said inlet and outlet ducts (84,88) has a generally constant cross-sectional configuration along substantially the entire length of the ducts (84,88).

6. The noise reduction enclosure (18) of claim 5, wherein each of said inlet and outlet ducts (84,88) has a generally square cross-sectional configuration along substantially the entire length of the ducts (84,88).

7. The noise reduction enclosure (10) of claim 6, wherein said inlet duct (84) includes a partition (85) positioned within the inlet duct (84) dividing the inlet duct (84) into a pair of generally square cross-sectionally configured inlet ducts (84) and said outlet duct (88) includes a partition (89) positioned within the outlet duct (88) dividing the outlet duct (88) into a pair of generally square cross-sectionally configured outlet ducts (88).

8. The noise reduction enclosure (10) of claim 1, and further comprising a damping material (100) attached to at least a portion of the interior surfaces of said inlet duct (84) and said outlet duct (88).

9. The noise reduction enclosure (10) of claim 8, wherein said damping material is attached between the interior surfaces of said inlet duct (84) and said outlet duct (88) and said absorptive material (102).

10. The noise reduction enclosure (10) of claim 1, wherein said absorptive material (102) is constructed of an acoustic foam.

11. The noise reduction enclosure (10) of claim 1, wherein said absorptive material (102) is constructed of a fiberglass material.

12. The noise reduction enclosure (10) of claim 1, wherein each of said curved portions (87,91) is constructed having approximately a 90 degree angle curve.

13. The noise reduction enclosure (10) of claim 1, wherein said engine portion (56) defines an engine compartment (57) therein containing said engine (14), said engine compartment (57) being adapted for receiving said cooling medium (82) from said inlet duct (84) and exhausting said cooling medium (82) within said engine portion (56) prior to discharge to said outlet duct (88).

14. The noise reduction enclosure (10) of claim 13, wherein said engine portion (56) includes a plurality of guide vanes (92) adapted for receiving said cooling medium (82) from said engine compartment (57) and guidingly directing said cooling medium (82) into the outlet duct (88).

15. A noise reduction enclosure (10) adapted for use with an engine (14), comprising:

a housing (32) having a generally rectangular shape and being divided into a duct portion (54) and an engine portion (56);

said duct portion (54) being disposed above said engine portion (56) and having an inlet opening (50) and an outlet opening (52) in fluid communication therewith;

said duct portion (54) further including an inlet duct (84) through which a cooling medium (82) flows from said inlet opening (50) to said engine portion (56) and an outlet duct (88) through which said cooling medium (82) exits from said engine portion (56) to said outlet opening (52);

said inlet duct (84) and said outlet duct (88) being disposed adjacent one another within said duct portion (54) wherein one of said inlet duct (84) and said outlet duct (88) is disposed between the other of said inlet duct (84) and outlet duct (88) and said engine portion (56); and an absorptive material (102) attached to at least a portion of the interior surfaces of said inlet duct (84) and said outlet duct (88).

16. The noise reduction enclosure (10) of claim 15, wherein said inlet duct (84) is disposed in said duct portion (54) between said outlet duct (88) and said engine portion (56).

17. The noise reduction enclosure (10) of claim 16 wherein said housing (32) includes a side wall (36) and an end wall (38), said inlet opening (50) being positioned in said side wall (36) and said outlet opening (52) being positioned in said end wall (38).

18. A noise reduction enclosure (10) adapted for use with an engine (14), comprising:

a housing (32) having a generally rectangular shape and being divided into a duct portion (54) and an engine portion (56);

said duct portion (54) being disposed above said engine portion (56) and having an inlet opening (50) and an outlet opening (52) in fluid communication therewith;

said duct portion (54) further including an inlet duct (84) through which a cooling medium (82) flows from said inlet opening (50) to said engine portion (56) and an outlet duct (88) through which said cooling medium (82) exits from said engine portion (56) to said outlet opening (52);

said inlet duct (84) and said outlet duct (88) each having a generally constant cross-sectional configuration along substantially the entire length of the ducts (84,88); and an absorptive material (102) attached to at least a portion of the interior surfaces of said inlet duct (84) and said outlet duct (88).

19. The noise reduction enclosure (18) of claim 18 wherein each of said inlet and outlet ducts (84,88) have a generally square cross-sectional configuration along substantially the entire length of the ducts (84,88).

20. The noise reduction enclosure (10) of claim 19 wherein said inlet duct (84) includes a partition (85) positioned within the inlet duct (84) dividing the inlet duct (84) into a pair of generally square cross-sectionally configured inlet ducts (84) and said outlet duct (88) includes a partition (89) positioned within the outlet duct (88) dividing the outlet duct (88) into a pair of generally square cross-sectionally configured outlet ducts (88).

* * * * *